US008353685B2

(12) United States Patent
Liu et al.

(10) Patent No.: US 8,353,685 B2
(45) Date of Patent: Jan. 15, 2013

(54) METHOD FOR FLUID TRANSFER AND THE MICRO PERISTALTIC PUMP

(75) Inventors: Chengxun Liu, Beijing (CN); Min Guo, Beijing (CN); Jing Cheng, Beijing (CN)

(73) Assignees: Capitalbio Corporation, Beijing (CN); Tsinghua University, Beijing (CN)

( * ) Notice: Subject to any disclaimer, the term of this patent is extended or adjusted under 35 U.S.C. 154(b) by 985 days.

(21) Appl. No.: 10/543,619

(22) PCT Filed: Jul. 14, 2003

(86) PCT No.: PCT/CN03/00563

§ 371 (c)(1),
(2), (4) Date: May 15, 2006

(87) PCT Pub. No.: WO2004/067964

PCT Pub. Date: Aug. 12, 2004

(65) Prior Publication Data

US 2006/0233648 A1 Oct. 19, 2006

(30) Foreign Application Priority Data

Jan. 28, 2003 (CN) ..... 2003 1 01875

(51) Int. Cl.
*F04B 17/00* (2006.01)

(52) U.S. Cl. ..... 417/413.1; 417/420

(58) Field of Classification Search ..... 417/53, 417/413.1, 420, 477.1–477.14, 244, 476, 417/474, 322, 412; 604/153
See application file for complete search history.

(56) References Cited

U.S. PATENT DOCUMENTS

| | | | | | |
|---|---|---|---|---|---|
| 2,941,477 | A | * | 6/1960 | Dalton | 417/420 |
| 2,971,471 | A | * | 2/1961 | Huebschman | 417/322 |
| 3,511,583 | A | * | 5/1970 | Brown | 417/412 |
| 3,768,931 | A | * | 10/1973 | Willis, Jr. | 417/322 |
| 3,992,132 | A | * | 11/1976 | Putt | 417/271 |
| 4,150,922 | A | * | 4/1979 | Cuenoud et al. | 417/45 |
| 4,515,535 | A | * | 5/1985 | D'Silva | 417/360 |
| 4,518,327 | A | * | 5/1985 | Hackman | 417/477.3 |
| 4,895,500 | A | * | 1/1990 | Hok et al. | 417/566 |
| 4,968,229 | A | * | 11/1990 | Neuder | 417/474 |
| 5,083,908 | A | * | 1/1992 | Gagnebin et al. | 417/477.1 |
| 5,085,562 | A | | 2/1992 | Van Lintel | |
| 5,286,176 | A | * | 2/1994 | Bonin | 417/413.1 |

(Continued)

FOREIGN PATENT DOCUMENTS

EP 0 134 614 3/1985

(Continued)

OTHER PUBLICATIONS

International Search Report for PCT/CN03/00563, mailed on Nov. 6, 2003, 3 pages.

(Continued)

*Primary Examiner* — Charles Freay
*Assistant Examiner* — Alexander Comley
(74) *Attorney, Agent, or Firm* — Morrison & Foerster LLP

(57) ABSTRACT

This invention relates generally to the field of peristaltic pump. In particular, the invention provides a peristaltic pump, which peristaltic pump comprises, inter alia, an actuating part, a cartridge part comprising at least three chambers and mechanisms for controlling movement of the actuating part to and from the cartridge part to control opening or closing of the inlet and outlet to the chamber(s).

31 Claims, 15 Drawing Sheets

U.S. PATENT DOCUMENTS

| | | | | | |
|---|---|---|---|---|---|
| 5,499,909 | A | * | 3/1996 | Yamada et al. | 417/384 |
| 5,599,175 | A | * | 2/1997 | Tojo et al. | 417/420 |
| 5,665,070 | A | * | 9/1997 | McPhee | 604/131 |
| 5,694,196 | A | * | 12/1997 | Hirai et al. | 351/200 |
| 5,709,539 | A | * | 1/1998 | Hammer et al. | 417/477.3 |
| 5,759,015 | A | | 6/1998 | Van Lintel et al. | |
| 6,033,191 | A | * | 3/2000 | Kamper et al. | 417/322 |
| 6,050,787 | A | * | 4/2000 | Hesketh | 417/412 |
| 6,062,829 | A | | 5/2000 | Ognier | |
| 6,074,365 | A | * | 6/2000 | Hahndel et al. | 604/151 |
| 6,102,678 | A | | 8/2000 | Peclat | |
| 6,293,926 | B1 | | 9/2001 | Sorensen et al. | |
| 6,364,637 | B1 | | 4/2002 | Hase et al. | |
| 6,416,293 | B1 | | 7/2002 | Bouchard et al. | |
| 6,439,845 | B1 | * | 8/2002 | Veres | 415/206 |
| 6,729,856 | B2 | * | 5/2004 | Cabuz et al. | 417/322 |
| 2002/0146333 | A1 | * | 10/2002 | Drevet | 417/410.1 |

FOREIGN PATENT DOCUMENTS

| | | | |
|---|---|---|---|
| EP | 1 078 879 | | 2/2001 |
| EP | 1 099 154 | | 5/2001 |
| GB | 2 314 591 | A | 1/1998 |
| JP | 54-108912 | A | 8/1979 |
| JP | 7-119640 | A | 5/1995 |
| JP | 9-502783 | A | 3/1997 |
| JP | 9-287571 | A | 11/1997 |
| JP | 2001-3873 | A | 1/2001 |
| SU | 1691549 | | 11/1991 |
| WO | WO-96/01371 | A1 | 1/1996 |
| WO | WO-01/28682 | | 4/2001 |

OTHER PUBLICATIONS

Japanese Utility Model Publication for Opposition No. 7-12213, three pages. (No English Translation.).

European Communication mailed on Mar. 24, 2011, for EP Application No. 03 815 512.3, filed on Jul. 14, 2003, seven pages.

* cited by examiner

METHOD FOR FLUID TRANSFER AND THE MICRO PERISTALTIC PUMP

Cross-Reference to Related Applications

This application is the national phase of PCT application PCT/CN2003/000563 having an international filing date of Jul. 14, 2003, which claims priority from China application number 03101875.0 filed Jan. 28, 2003. The contents of these documents are incorporated herein by reference.

TECHNICAL FIELD

This invention relates generally to a method for fluid transfer and a micro peristaltic pump based upon the method.

BACKGROUND ART

Microfluidic devices have been widely used in biomedical, biochemical and trace analysis, etc. On the great demand of the reliability for bioanalytical devices, disposable cartridges or chips are more and more welcomed as the carrier for reaction and detection. Sometimes fluid is injected into the cartridge or chip manually but this will result in low reliability. On the other hand, a micropump is often not easy and too expensive to be integrated into the disposable part.

Many kinds of micropumps have been studied in the recent years. Unlike conventional peristaltic pumps which commonly comprise a flexible tube and three or more rollers (See e.g., U.S. Pat. Nos. 6,062,829 and 6,102,678, and European Patent Nos. 1,078,879 and 1,099,154), micro pumps generally consist of three or more chambers among which fluid is transferred from one to another (See e.g., U.S. Pat. Nos. 5,085,562 and 5,759,015, and WO01/28,682). For example, in WO01/28,682, three identical chambers are connected in tandem and driven independently by three drives in a peristaltic time sequence and then fluid is transferred.

DISCLOSURE OF THE INVENTION

This invention addresses the above and other related concerns in the art by presenting a method for fluid transfer and a micro peristaltic pump based upon the method.

In one aspect, the present invention is directed to a method for fluid transfer, which comprises: a) an actuating part comprising a motor and a first force effector driven by the motor; b) a cartridge part comprising an elastic membrane attached to a cartridge body, wherein said elastic membrane attached to said cartridge body forms an enclosed space within the cartridge body comprising at least three chambers, and the cartridge also comprising a second force effector which interacts with the first force effector; c) at least three said chambers have inlets and outlets, which are sealingly connected in tandem; and d) means for controlling movement of the first force effector to and from said cartridge part in a plane substantially parallel to the plane comprising said cartridge part, whereby said chambers covered by the first force effector are open or close by the interaction of the first and second force effector.

Said first force effector is unsymmetrically attached to the motor and is rotated by the motor to interact with the second force effectors configured along the circular track.

Said first force effector is attached to the motor and is moved straightly by the motor to interact with the second force effectors configured along the linear track.

When said first force effector is not in close proximity to said second force effector, said chamber are kept closed or open by said second force effector, and when said first force effector is in close proximity to said second chamber, said chamber are kept open or closed by the interaction of said first and second force effector.

Either the first force effector or the second force effector is ferromagnetic, and the other is ferromagnetic, paramagnetic or any type of magnetic substrate that can generate magnetic force with ferromagnet.

Both said first and second force effector are electrically charged and thus interact by electrostatic force.

In another example, the working surface of the first force effector has a wave shape circumfenrentially. The movement of the first force effector into close proximity to the cartridge part results in contact between the first and second force effector and the contact opens the chambers the actuating part covers. When the first force effector moves away, the contact between the first and second force effector disappears and thus the chambers are close again. Preferably, the flat spring comprises a metal, a plastic or another flexible material.

In still another example, a third force effector was set in the cartridge referring to and interacts with said second force effector.

The movement of the first force effector into close proximity to the cartridge part results in contact between the first and second force effector and the contact opens the chambers the actuating part covers. When the first force effector moves away, the contact between the first and second force effector disappears and thus the chambers are close again.

When said first force effector is not in close proximity to said chambers, the chambers are kept closed or open by the interaction of said second and third force effector, and when said first force effector is in close proximity to said chambers, the chambers are kept open or closed by the strong interaction between said first and second force effector over said third force effector.

Said third force effector is driven along with the first force effector, alternatively and oppositely, by the motor in the actuating part.

Said third force effector is ferromagnetic, paramagnetic or any type of magnetic substrate that can generate magnetic force with the second force effector, which prevents the chambers from being kept close or open by the second force effector.

Both the second and third force effector are electrically charged and thus interact by electrostatic force, which prevents the chambers from being kept close or open by the second force effector.

Said third force effector is a flat spring with one end fixed to the cartridge and the other end prevents the chambers from being kept close or open by the second force effector.

A spacing cover was fixed to the cartridge between the first and second force effector to define the extent to which the chamber is open.

A micro peristaltic pump, which comprises: a) an actuating part comparing a motor and a first force effector driven by the motor; b) a cartridge part comprising an elastic membrane attached to a cartridge body, wherein said elastic membrane attached to said cartridge body forms an enclosed space within the cartridge body comprising at least three chambers, and the cartridge also comprising a second force effector which interacts with the first force effector; c) at least three said chambers have inlets and outlets, which are sealingly connected in tandem.

There are three chambers within said cartridge, wherein every chamber has its inlet and outlet, and all inlets and outlets are connected in tandem with the inlet of the first chamber and the outlet of the third chamber serving as the inlet and outlet for the fluidic system in the cartridge.

A spacing cover was fixed to the cartridge between the first and second force effector.

Said spacing cover, elastic membrane and cartridge were fixed together by screws.

A third force effector was set in the cartridge referring to and interacts with said second force effector.

Either the first force effector or the second force effector is ferromagnetic, and the other is ferromagnetic, paramagnetic or any type of magnetic substrate that can generate magnetic force with ferromagnet.

Both said first and second force effector are electrically charged and thus interact by electrostatic force.

Said third force effector is a flat spring with one end fixed to the cartridge and the other end interacts with said second force effector by contact.

The working surface of said first force effector has a wave shape circumfenrentially, where the first force effector interacts with the second force effector.

According to the first force effector, a third force effector is set in the cartridge with the second force effector, and has some convex parts in order to interact mechanically with the first force effector by contact.

Said third force effector is a flat spring which has a convex part.

Said first force effector is a sector permanent magnet which is unsymmetrically attached by a flange to the rotor of said motor, and all chambers within the cartridge are configured along the circular track of the first force effector.

Said first force effector was fixed to a linear motor, and all chambers within the cartridge are configured along the linear track of the first force effector.

Said first force effector is manufacturered as a part of said motor.

Said elastic membrane is made of rubber or poly-siloxane, and is attached to said cartridge by adhesion, welding or ultrasonic welding.

The inlet and outlet of said chambers are connected via external tubings or via fabricated channels on the cartridge part.

Said second force effector is fabricated to the interior of said elastic membrane.

Said second force effector is attached to the elastic membrane by adhesion, welding or mechanical means.

BRIEF DESCRIPTION OF THE DRAWINGS

FIG. 4-1 is the cross-sectional view of an exemplary fabricated cartridge body shown in FIG. 4.

FIG. 4-2 is the local cross-sectional view of an exemplary fabricated cartridge body shown in FIG. 4-1.

FIG. 7-1 to 7-10 are the cross-sectional view and top view schematics depicting every phase of an exemplary working cycle in which the first force effector is rotated by a motor.

FIG. 8 illustrates the restoring force generation by an exemplary flat spring.

FIG. 9 is the cross-sectional view of an exemplary system assembly in which the actuator functions by contacting the cartridge part.

FIG. 10 is a schematic of the force generated by an elastic membrane.

FIG. 12-1 to 12-10 are the cross-sectional view and top view schematics depicting every phase of an exemplary working cycle in which the first force effector moves straightly.

MODES OF CARRYING OUT THE INVENTION

An exemplary micro peristaltic pump comprises two separate parts: a cartridge (or chip) and an actuator. They can work together with or without physical contact.

The cartridge comprises at least three valve-shaped chambers each of which has a valve seat, valve membrane on which the second force effector is attached to interact with the first force effector. The chamber is enclosed by the elastic membrane and the structure of the cartridge, wherein a pair of inlet/outlet ports was fabricated. All ports of the chambers are connected in tandem and the left two serve as the inlet and outlet ports for the whole system. A flat spring may be mounted on the cartridge for every chamber to generate the deformation force that will press the valve membrane onto the valve seat. A spacing cover may also be necessary to ensure a unified stroke of all membranes. The actuator part comprises a motor and a sector working part and they are linked mechanically by a flange on the rotor of the motor. The sector working part can be a sector permanent magnet and interact with another magnet attached to the elastic membrane. In this case the sector permanent magnet is the first force effector and the magnet on the membrane is the second force effector while the flat spring is the third force effector.

The fluid transfer is realized in this invention by means that when said sector permanent magnet is in close proximity, but not necessarily with physical contact, to said chambers, the elastic membrane is dragged up from or pressed onto the valve seats. On the other hand, the elastic membrane will be tightly pressed on the valve seats by the deformation force of the flat springs. The vertical displacement of the elastic membrane is defined by the spacing cover. Since the three chambers are fabricated within the cartridge in a deliberate pattern, the rotating sector permanent magnet will cover every chamber and consequently lead to the alternative open and close states for every chamber in a peristaltic time sequence. Thus the fluid is transported from one chamber to another in the peristaltic manner. The flow rate as well as direction can be changed simply by controlling the rotation speed and direction of the sector magnet.

A typical structure of the exemplary pump comprises a cartridge part and an actuating part as shown in FIG. 1 to 5. The actuating part is fixed to the device body and consists of a motor 23, a flange 12 and a sector permanent magnet 1. The flange 12 can be mounted on the rotor of the motor 23 by screw 22. The sector magnet 1 is attached by the flange 12 to the rotor of the motor 23 by adhesion or welding, and then is able to rotate with it.

Figure 1:
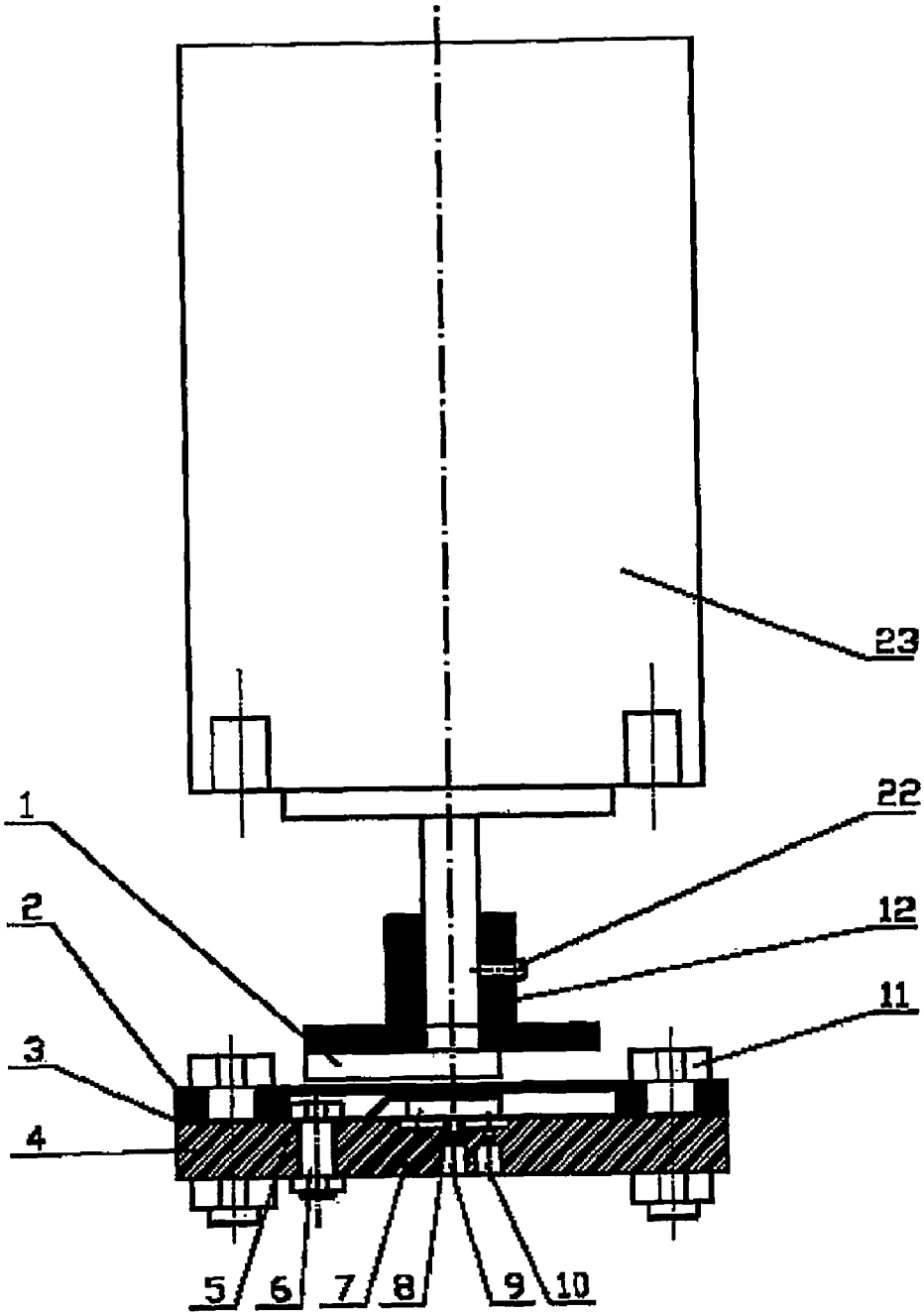
FIG. 1 is the cross-sectional view of an exemplary micro peristaltic pump with flat springs providing the restoring force.
Figure 2:
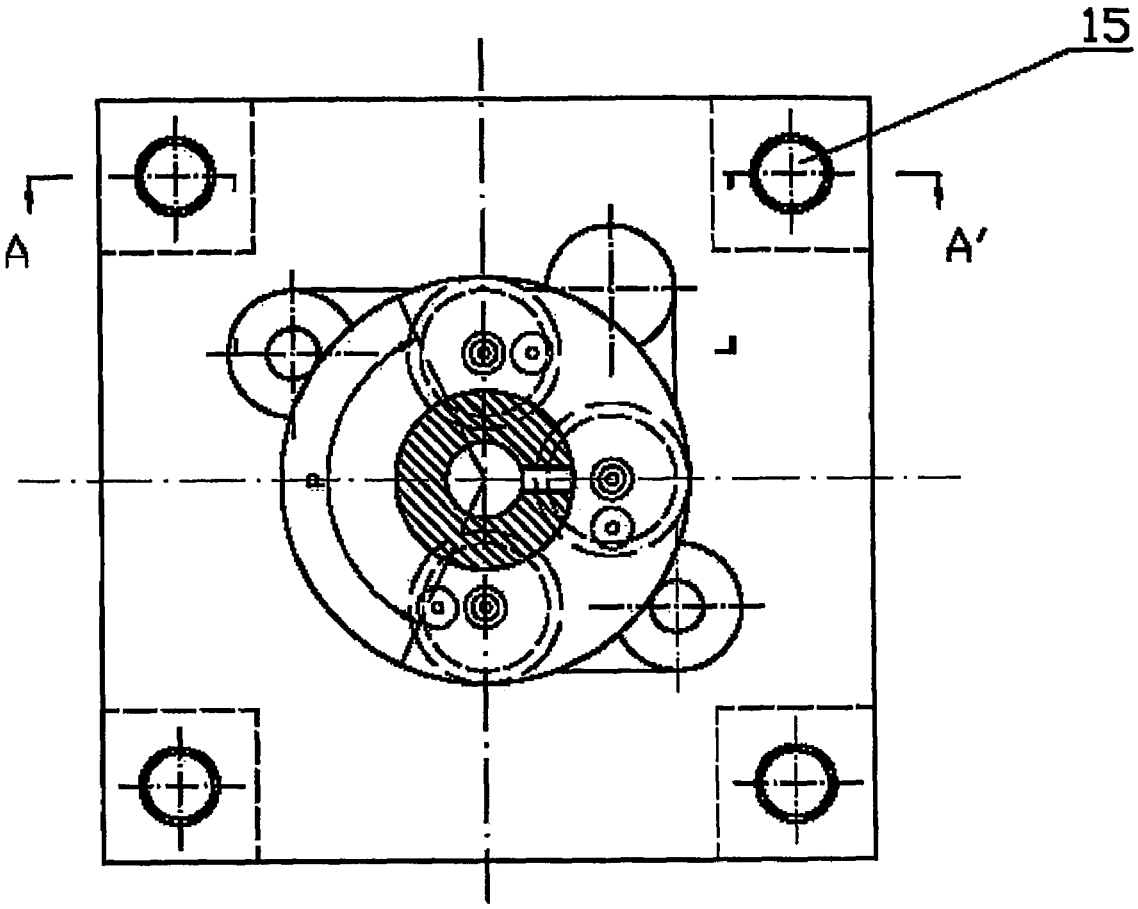
FIG. 2 is the top view of the exemplary micro peristaltic pump, shown in FIG. 1, without motor.
Figure 3:
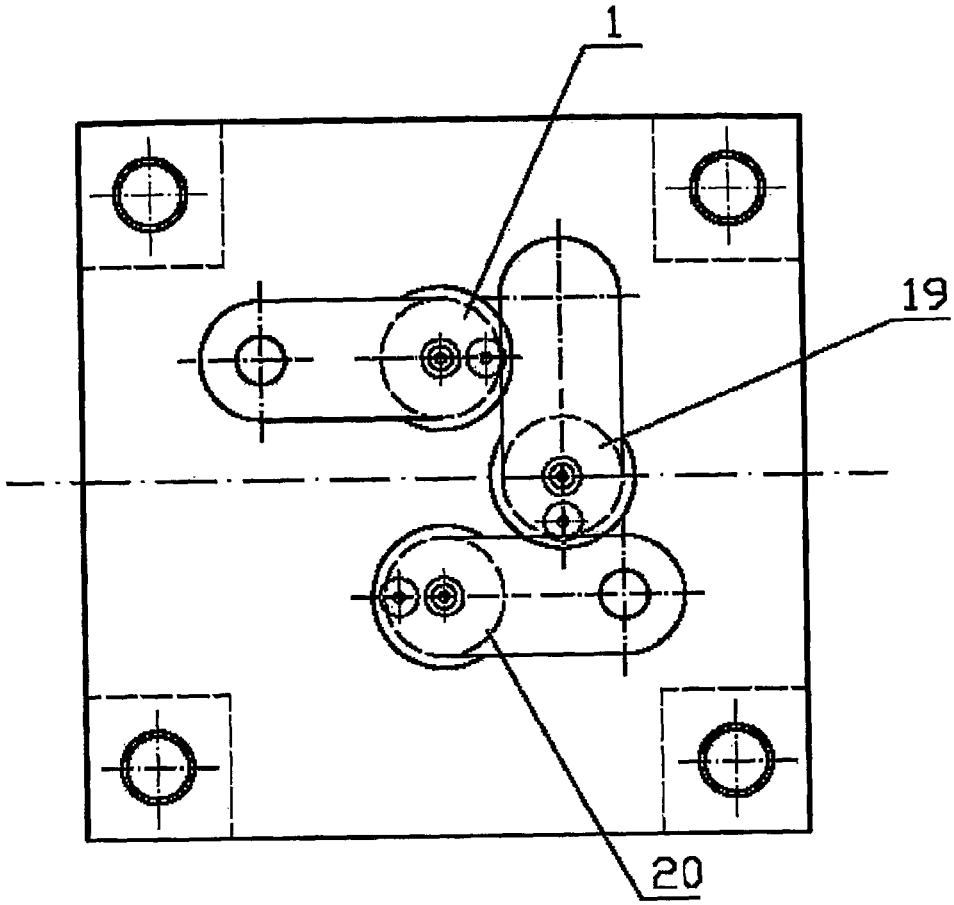
FIG. 3 is the top view of an exemplary cartridge assembly with flat springs.
Figure 4:
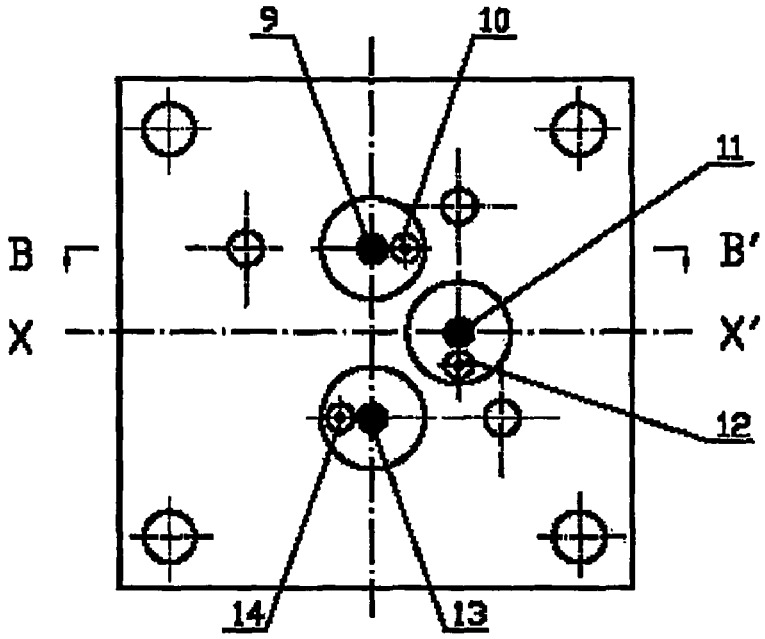
FIG. 4 is the top view of an exemplary fabricated cartridge body.
Figures 1, 4:
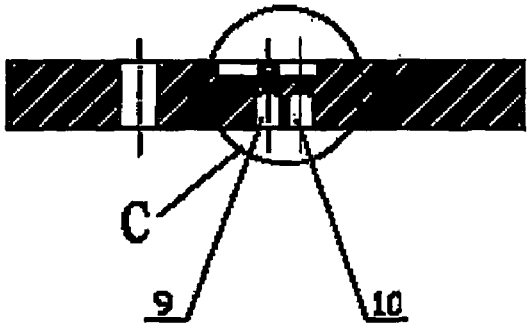
Figures 2, 4:
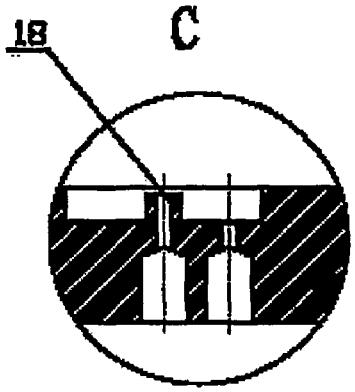

The main components within the cartridge include the cartridge body 4, elastic membrane 3, magnet 7 attached to the membrane 3 for each chamber within cartridge 4, a spacing cover 2 and may also include screws 6 and 11 and a flat spring 5 for each chamber if it is designed to generate the pre-tightening and restoring forces (See FIG. 1 to 3). The cartridge can be made of metals, glass or plastics. FIG. 4, 4-1 and 4-2 show the cartridge structure of the chambers including the valve seat 18, the inlet/outlet ports 9, 10, and the cavity. To close the chamber, the elastic membrane 3 is applied to the cartridge 4 by adhesion, welding or ultrasonic welding. A piece of magnet 7 may be attached to the outer side of the valve membrane 3. It can be either paramagnetic or ferromagnetic. If the latter, the magnetic pole of its upper side should not be the same with that of the bottom side of the sector magnet 1. Magnet 7 can be adhered to membrane 3 or be integrated into it by fabrication. As stated a little earlier, a flat spring 5 may be applied for each chamber membrane to generate the pre-tightening force and restoring force. The flat spring 5 can be made of metal, plastic or any type of appropriate flexible materials. One of the two ends of the flat spring 5 is fixed to the cartridge body 4 or to the spacing cover 2 by screw 6 or any other means. The other end of the flat spring 5 is attached to the upper side of the magnet 7 by adhering, welding or mechanical means, etc. At this time, the chamber membrane 3, the membrane magnet 7 and the flat spring 5 have been mounted in tandem on the cartridge.

As illustrated in FIGS. 1 and 2, magnetic attraction will be generated by the sector magnet 1 and membrane magnet 7 when the former rotates over the latter. When the magnetic force is larger enough than the restoring force imposed from the flat spring 5 to membrane 3, the membrane magnet 7 along with the membrane 3 will be dragged up from the valve seat to the spacing cover 2. Thus the chamber is open and the fluidic pathway is connected here. The magnetic attraction disappears when the sector magnet 1 moves away; and then the membrane 3 and the membrane magnet 7 will be pressed back to the valve seat as its normal state by the pressure from the flat spring 5. This is the working style for all chambers within the cartridge.

Figure 5:
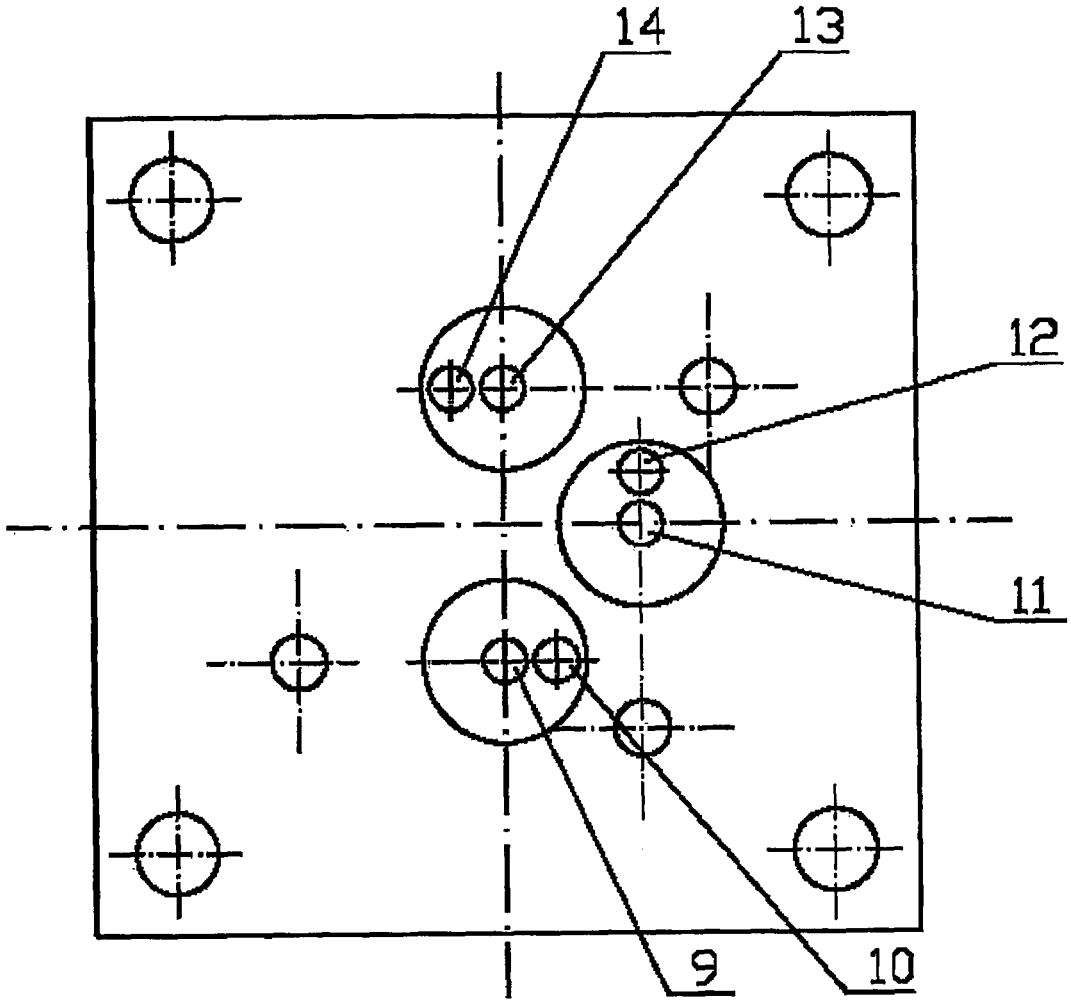
FIG. 5 is the bottom view of an exemplary cartridge.

The inlet and outlet ports for all valve structures within the cartridge are connected in tandem to enable a fluidic pipeline except the very beginning and end of the pathway. As depicted in FIG. 4 and 5, external tubes may be employed to connect port 10, 11 and port 12, 13. Consequently the ports 9 and 14 will function as the inlet and outlet ports for the whole system. The fluidic pathway connection can also be realized by fabricated channels in the cartridge, for instance, 16 and 17 in FIG. 6.

Figures 1, 7:
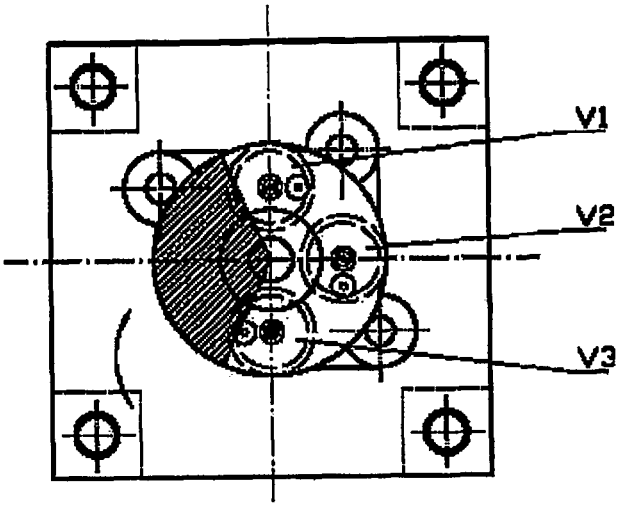
Figures 2, 7:
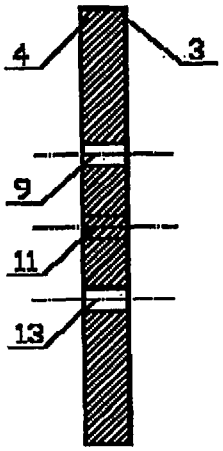
Figures 3, 7:
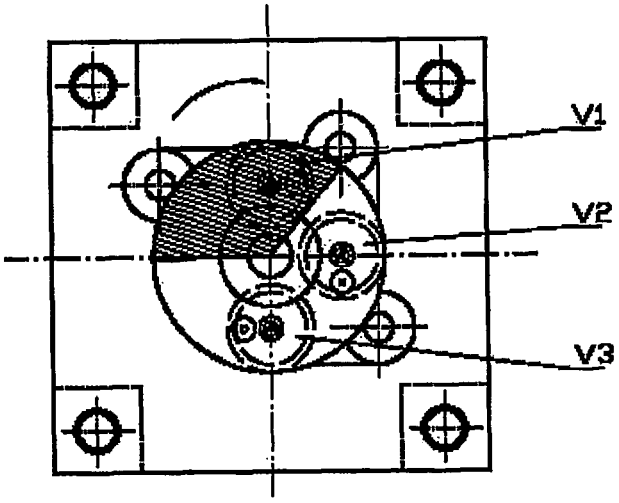
Figures 4, 7:
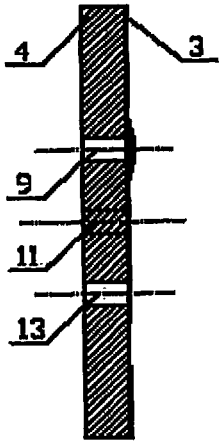
Figures 5, 7:
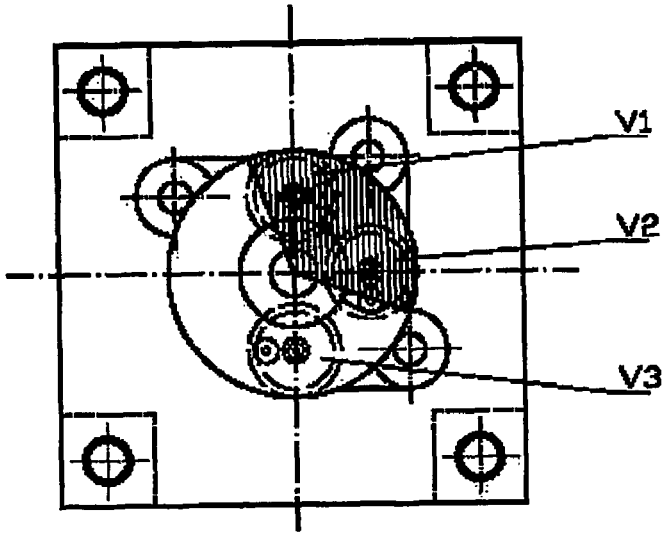
Figures 6, 7:
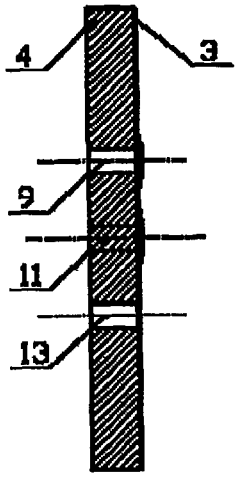
Figure 7:
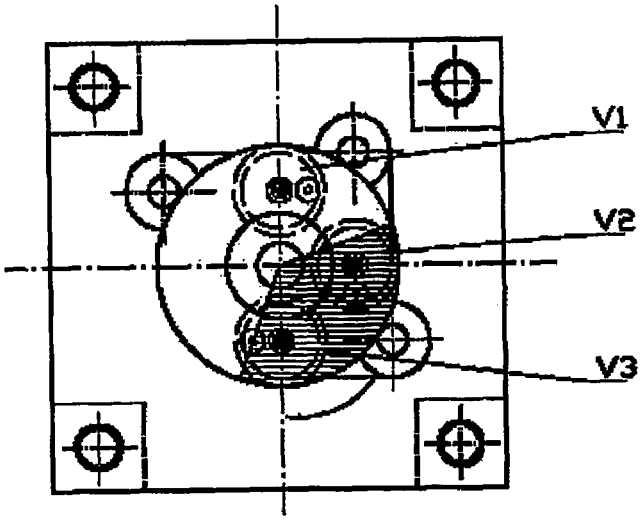

The following states come forth one by one in a whole rotation cycle of magnet 1:

(a) The initial state, shown in FIG. 7-1 and 7-2. None of the membrane magnets is covered by the sector magnet 1. Thus all the valve-structured chambers are close.

(b) See FIG. 7-3 and 7-4. Valve V1 is covered by the sector magnet 1 and thus is open while valve V2 and V3 are still close. Consequently the fluid is inhaled into the chamber of V1.

Figure 6:
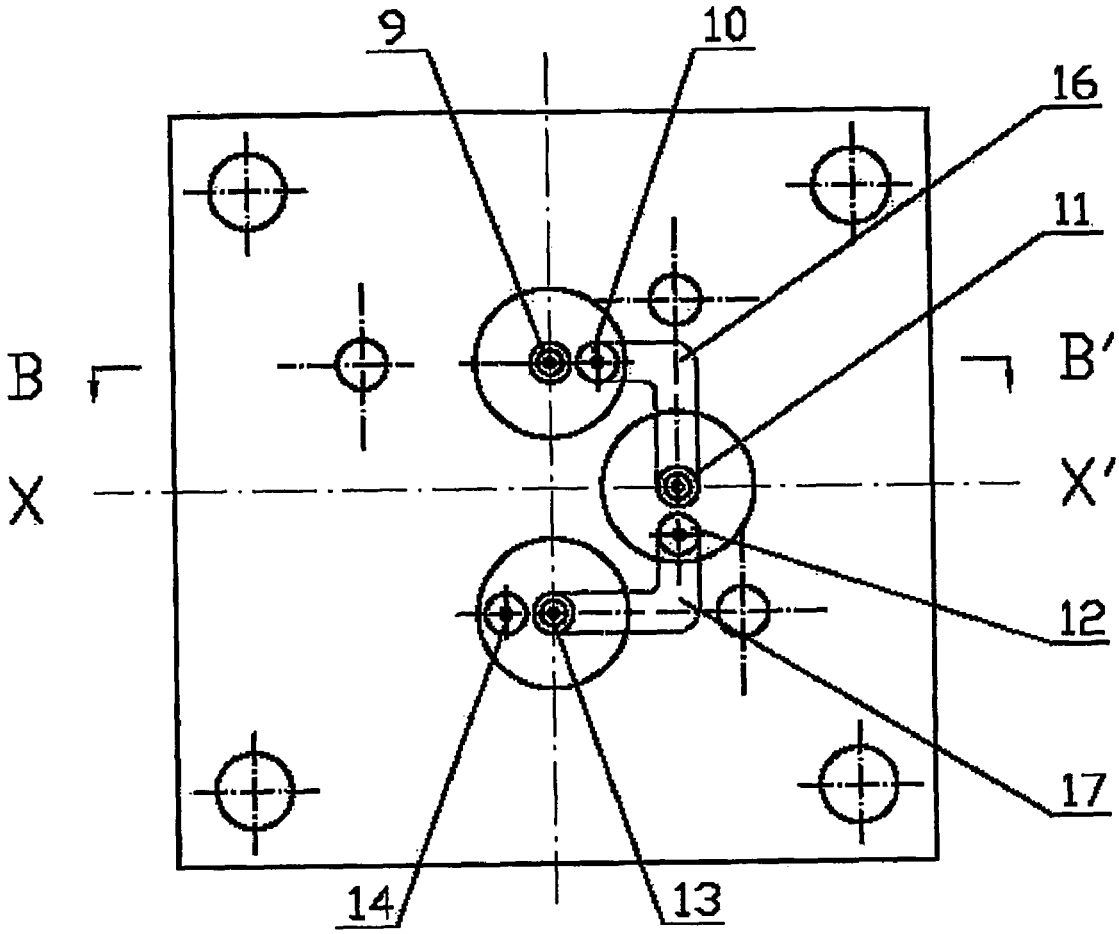
FIG. 6 is the top view of an exemplary cartridge with fabricated fluidic channels.
Figures 7, 8:
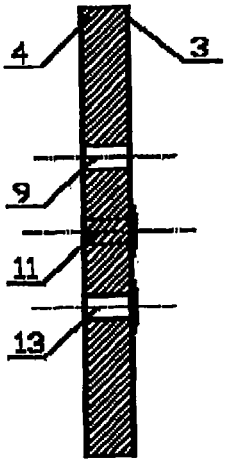

(c) See FIG. 7-5 and 7-6. Valve V1 and V2 are both covered by the rotating sector magnet 1 and thus both are open. Thus the fluid inhaled into the chamber V1 in the former step is transferred to the chamber of V2. And another volume of fluid is inhaled to fill the chamber of V1 from the inlet port 9. (d) See FIG. 7-7 and 7-8. The sector magnet 1 moves away from the membrane magnet on V1, and the fluid inside V1's chamber is expelled out through the inlet port before the sector magnet 1 reaches the valve V3. And then when V3 is covered by the sector magnet 1 V3 is open, while during the transition of the states, the chamber V2 remains open and holds the fluid in its chamber. Then the chamber of V3 is filled with the fluid inhaled from the outlet port 14. In other words, the chambers of V2 and V3 are both full of fluid at this time.

(e) See FIG. 7-9 and 7-10. The valve V2 is close when the sector magnet 1 moves away from it. Consequently the fluid in V2 is transferred to V3 and expels out the fluid in V3 through the outlet port 14.

(a) When the sector magnet keeps rotating, the system returns to the initial state.

Following the procedures described above, fluid can be transferred from the inlet port 9 to the outlet port 14. Flow rate can be increased by the speedup of the rotation of sector magnet 1 and pumping direction can be altered when the magnet rotates reversibly.

In FIG. 1, 22 is a screw by which the flange 12 is fixed on the rotor of the motor 23. In FIG. 2, 15 is the mounting hole for the assembly of spacing cover 2 to the cartridge body 4. In FIGS. 3, 19 and 20 are another two membrane magnets, which may be, but not necessarily, of the same material, shape and assembly methods as magnet 7. FIG. 4 shows a typical valve seat structure 18. FIG. 4-1 and 4-2 are the detailed drawings. As one of the embodiments, the membrane 3 can be adhered to cartridge base 4 by adhesive 21, shown in FIG. 8.

Not only can all the valve chambers work in the same manner as stated above, but also they can be actuated variously. Electrostatic force may be employed to open the valves as the substitution of the magnetic force in the previously mentioned method. The elastic force from the membrane itself can be used to restore the valve. Also, deformation force from the flat spring can serve to open the valve which is totally dependent on its initial shape.

Figures 7, 8, 9:
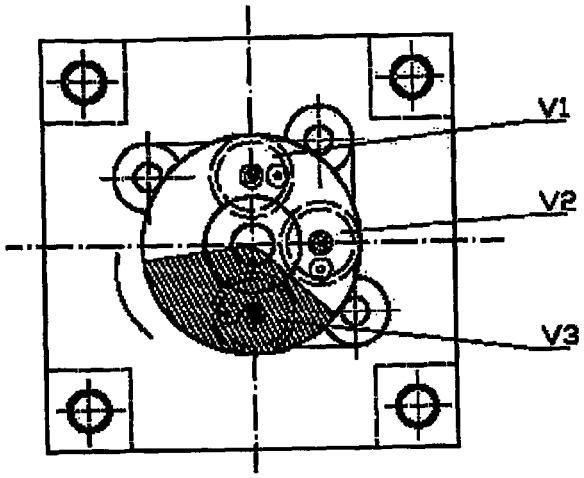

FIG. 9 illustrates another actuation method. The flange 12 can be fabricated into a specific shape to realize the pumping movement by contacting valve structures in the cartridge in the 3-phase peristaltic time sequence. This means the bottom surface of the flange can be machined to have a wave shape circumfenrentially, that is, instead of a flat surface, some areas of the bottom surface are lower than other areas in vicinity. When any one of these lower areas contacts the flat spring 5, which can be designed to have the chamber normally-open, the membrane 3 will be pressed onto the valve seat 18 within the cartridge body 4. When the lower area moves away, the membrane 3 will be received open by the flat spring 5.

Figures 7, 8, 9, 10:
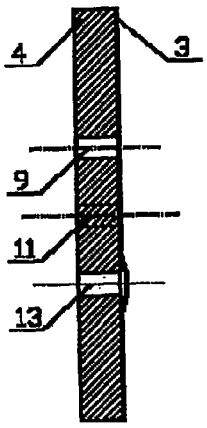
Figure 8:
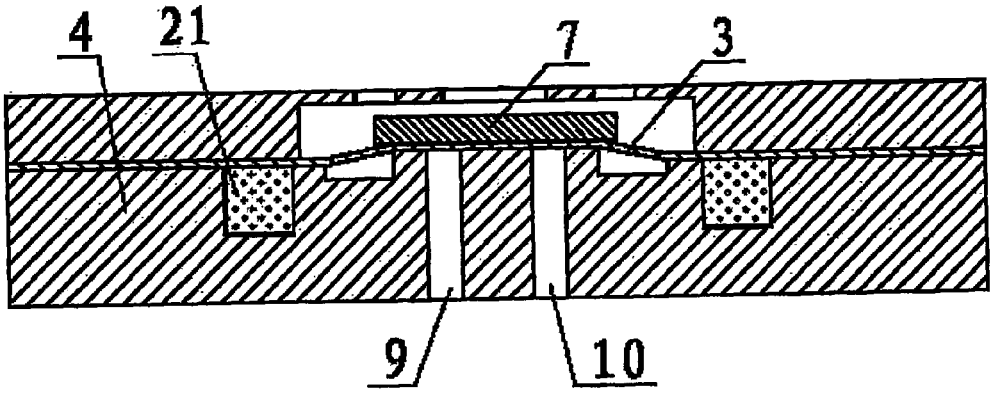
Figure 9:
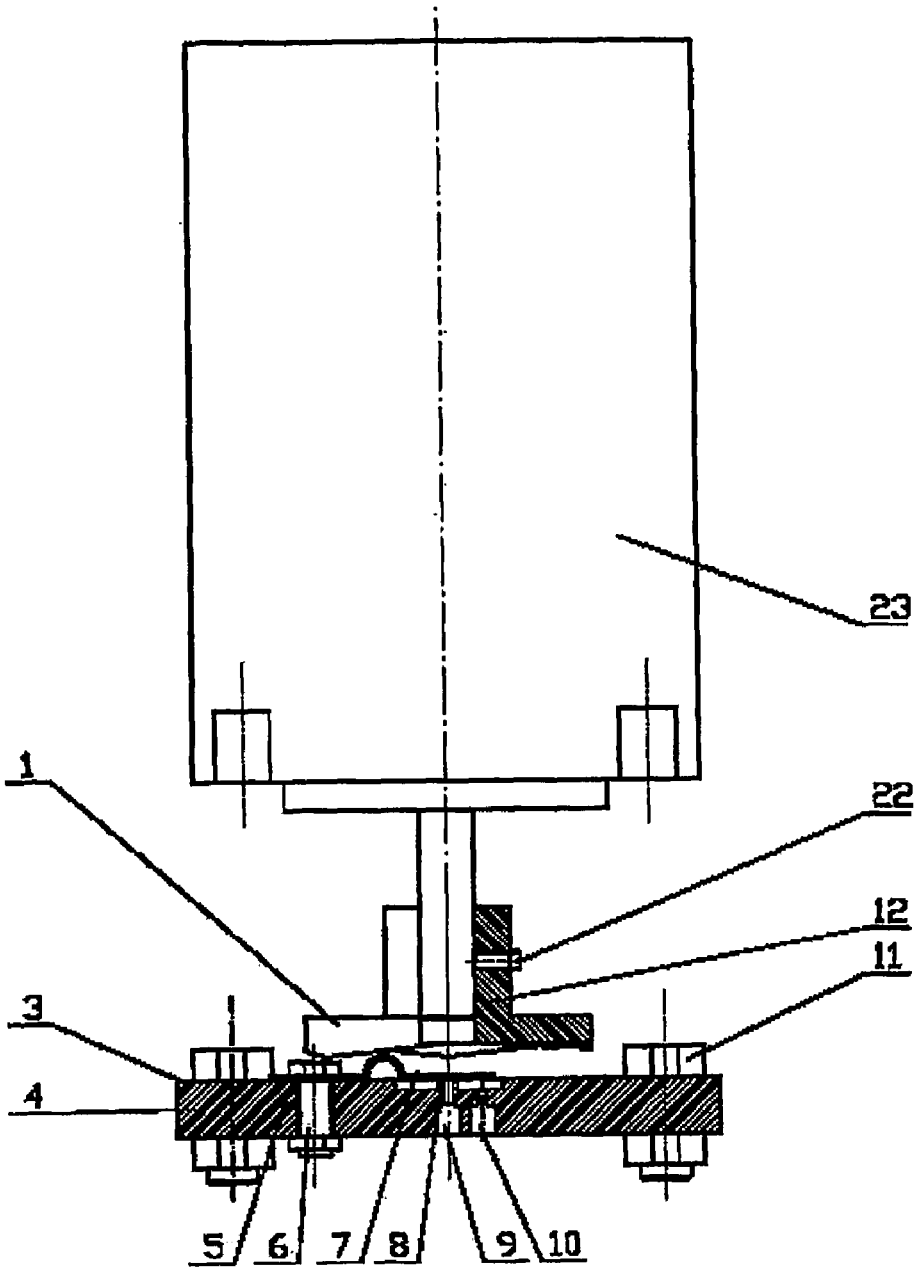
Figure 10:
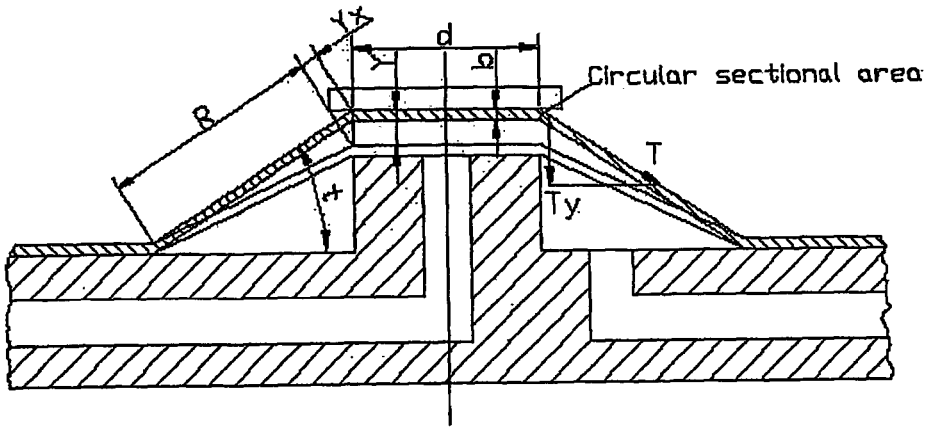
Figure 11:
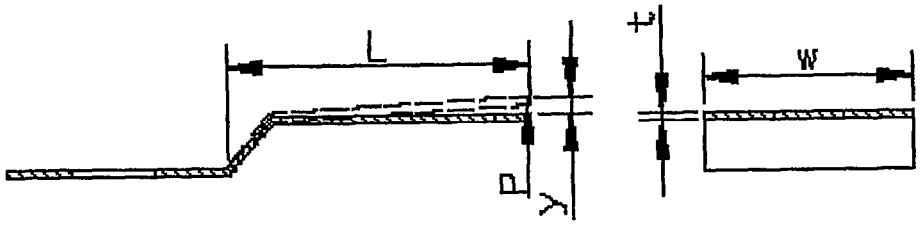
FIG. 11 illustrates a cantilever model of the flat spring.
Figures 1, 12:
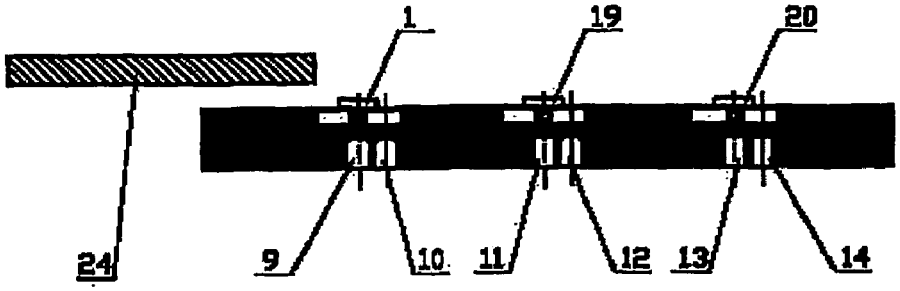
Figures 2, 12:
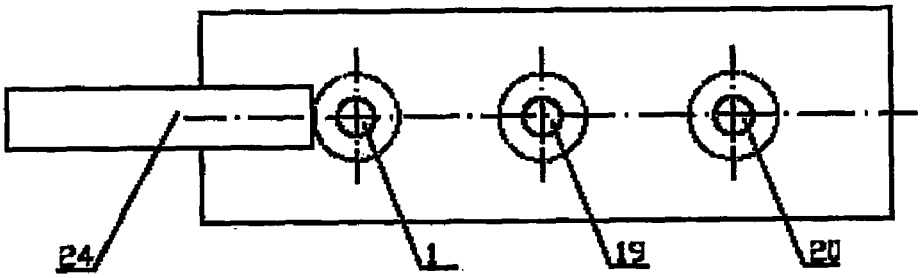
Figures 3, 12:
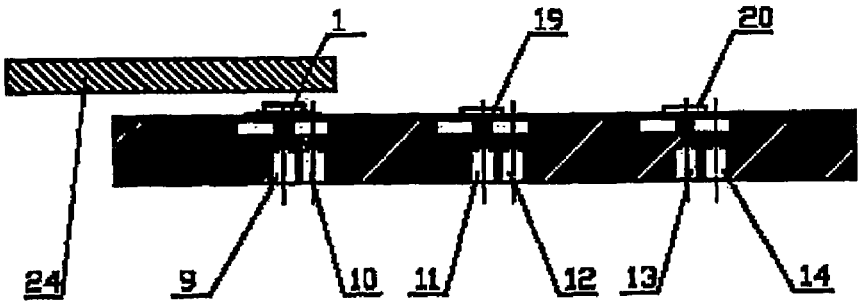
Figures 4, 12:
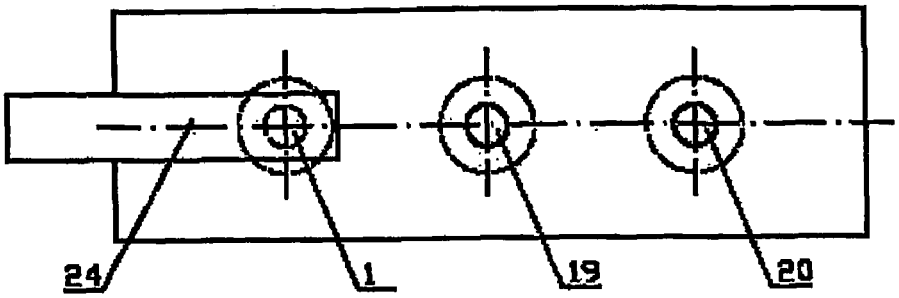
Figures 5, 12:
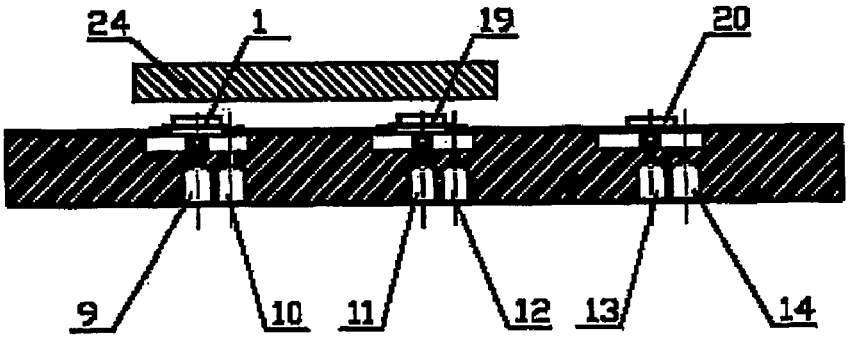
Figures 6, 12:
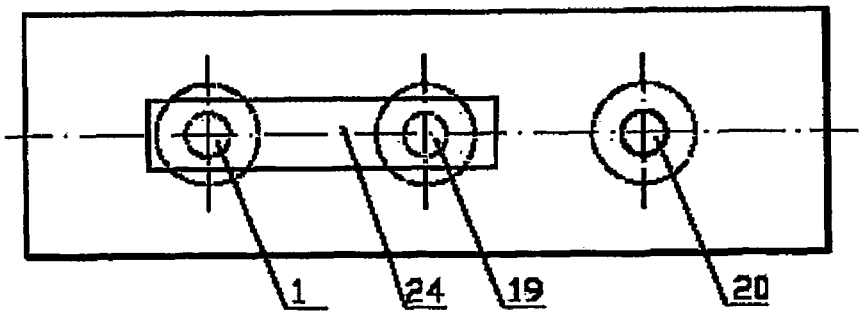
Figures 7, 12:
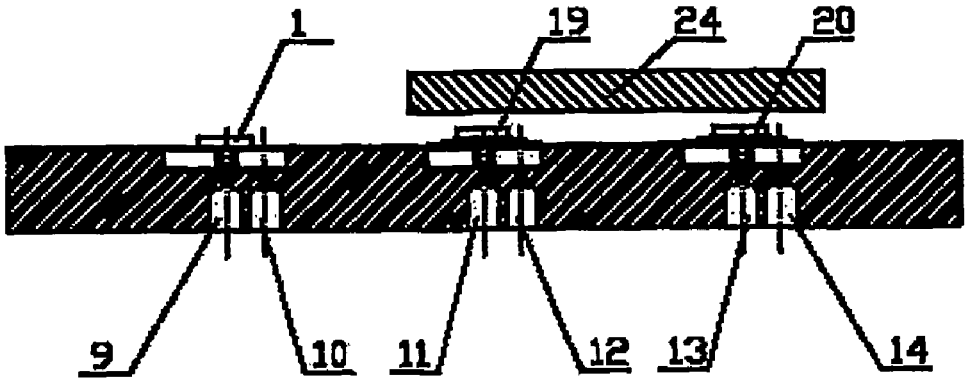
Figures 8, 12:
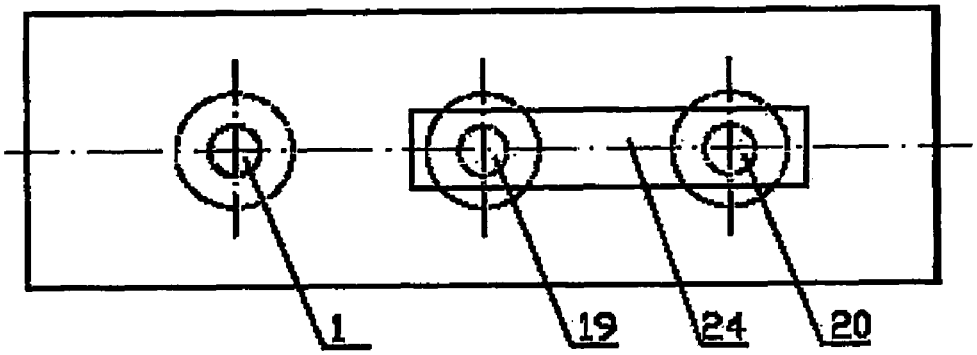
Figures 9, 12:
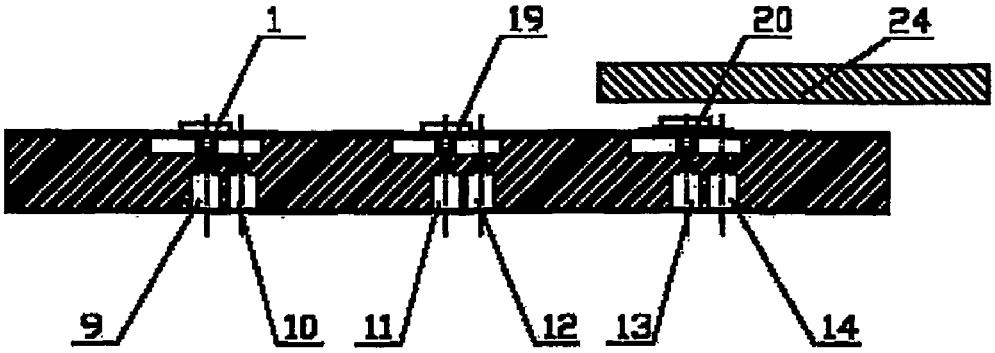
Figures 10, 12:
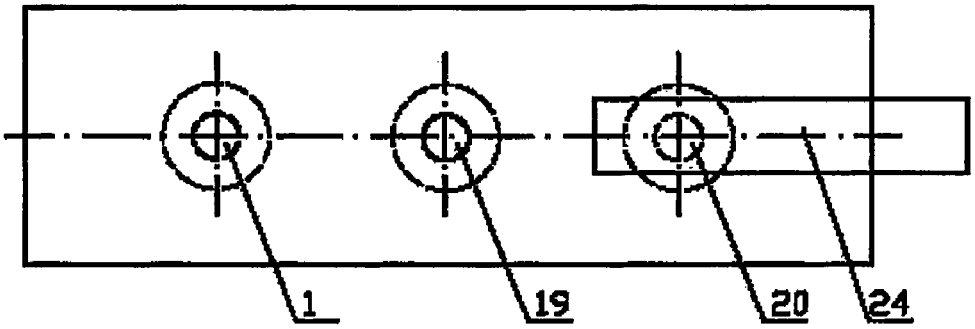

As still another embodiment, the permanent magnet can move straightly to generate the peristaltic time sequence. Of course in this case the permanent magnet is not a sector. All phases during the movement of the permanent magnet are shown in FIG. 12-1 to 12-10.

There are still some other types of force that can be used to actuate vertically to substitute the magnetic force and flat spring force in the stated embodiment. In fact, the essence of the present embodiment is the peristaltic movement formed by the single rotation of the sector working part 1, regardless of whatever type of vertical actuation. ureThe left end of flat spring 5 is fixed and the other end is free. For the free end of the flat spring, a displacement y will be generated by the externally applied force P and vice versa. Also, the restoring force can be provided by the elastic membrane 3 as depicted in FIG. 10. $Y_x$ is the radial component of the vertical deformation Y of the elastic membrane. Consequently a force T is generated by the vertical integral of $Y_x$ and $T_y$ is the vertical component.

Electrostatic force is generated between any two separate objects with electric charges. If the charges are both positive or negative, the two objects repel each other. If the charges are opposite, they attract each other. As another embodiment of the invention, 1 and 7 are charged to generate the electrostatic force. Therefore, electrostatic force actuates vertically in the same time sequence, formed by the rotating sector working part 1, as the one in the typical embodiment. it can be noticed that physical contact is absent for electrostatic actuation.

Any suitable number of chambers in the present peristaltic pumps can be sealingly connected to an inlet and an outlet. For example, more than 50% of the chambers in the present peristaltic pumps can be sealingly connected to an inlet and an outlet. Preferably, each chamber is sealingly connected to an inlet and an outlet. The inlet and outlet of any suitable number of chambers in the present peristaltic pumps can be connected. For example, the inlet and outlet of at least three chambers are connected. Preferably, the inlet and outlet of all chambers are connected.

In another specific embodiment, when the first force effector is not in close proximity to the chamber within the cartridge, the chamber are kept closed, and when the first force effector moves into close proximity to the chamber, the interaction between the actuating part and the cartridge part opens the chamber.

In still another specific embodiment, when the first force effector is not in close proximity to the chamber within the cartridge, the chamber are kept open, and when the actuating part moves into close proximity to the chamber, the interaction between the actuating part and the cartridge part closes the chamber. In this situation, a repelling, rather than an attractive, magnetic force can be used.

The above examples are included for illustrative purposes only and are not intended to limit the scope of the invention. Many variations to those described above are possible. Since modifications and variations to the examples described above will be apparent to those of skill in this art, it is intended that this invention be limited only by the scope of the appended claims.

For clarity of disclosure, and not by way of limitation, the nonmenclature with regard to this invention is provided below.

1. Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference.

2. As used herein, "a" or "an" means "at least one" or "one or more".

3. As used herein, "a plane substantially parallel to the plane comprising said cartridge part" means that the angle between the plane wherein the actuating part moves from and to the cartridge part and the plane comprising the cartridge part is less than 45 degrees or more than 135 degrees. Preferably, the angle between the plane wherein the actuating part moves from and to the cartridge part and the plane comprising the cartridge part is less than 30, 15, 10, 5, 2, 1 or less than 1 degree(s), or more than 150, 165, 170, 175, 178, 179 or more than 179 degrees. More preferably, the angle between the plane wherein the actuating part moves from and to the cartridge part and the plane comprising the cartridge part is 0 or 180 degrees, i.e., the two planes are completely parallel.

4. As used herein, "the actuating part is in close proximity to the cartridge part" means that the actuating part and the cartridge part are brought sufficiently close to achieve the desired opening or closing of chamber(s). Normal, the distance between the actuating part and cartridge part is about several micrometers to a few millimeters, e.g., from about 10 μm to about 5 mm.

5. As used herein, "magnetic substance" refers to any substance that has the properties of a magnet, pertaining to a magnet or to magnetism, producing, caused by, or operating by means of, magnetism.

6. As used herein, "magnetizable substance" refers to any substance that has the property of being interacted with the field of a magnet, and hence, when suspended or placed freely in a magnetic field, of inducing magnetization and producing a magnetic moment. Examples of magnetizable substances include, but are not limited to, paramagnetic, ferromagnetic and ferrimagnetic substances.

7. As used herein, "paramagnetic substance" refers to the substances where the individual atoms, ions or molecules possess a permanent magnetic dipole moment. In the absence of an external magnetic field, the atomic dipoles point in random directions and there is no resultant magnetization of the substances as a whole in any direction. This random orientation is the result of thermal agitation within the substance. When an external magnetic field is applied, the atomic dipoles tend to orient themselves parallel to the field, since this is the state of lower energy than antiparallel position. This gives a net magnetization parallel to the field and a positive contribution to the susceptibility. Further details on "paramagnetic substance" or "paramagnetism" can be found in various literatures, e.g., at Page 169-page 171, Chapter 6, in "Electricity and Magnetism" by B. I Bleaney and B. Bleaney, Oxford, 1975.

8. As used herein, "ferromagnetic substance" refers to the substances that are distinguished by very large (positive) values of susceptibility, and are dependent on the applied magnetic field strength. In addition, ferromagnetic substances may possess a magnetic moment even in the absence of the applied magnetic field, and the retention of magnetization in zero field is known as "remanence". Further details on "ferromagnetic substance" or "ferromagnetism" can be found in various literatures, e.g., at Page 171-page 174, Chapter 6, in "Electricity and Magnetism" by B. I Bleaney and B. Bleaney, Oxford, 1975.

9. As used herein, "ferrimagnetic substance" refers to the substances that show spontaneous magnetization, remanence, and other properties similar to ordinary ferromagnetic materials, but the spontaneous moment does not correspond to the value expected for full parallel alignment of the (magnetic) dipoles in the substance. Further details on "ferrimagnetic substance" or "ferrimagnetism" can be found in various literatures, e.g., at Page 519-524, Chapter 16, in "Electricity and Magnetism" by B. I Bleaney and B. Bleaney, Oxford, 1975.

What is claimed is:

1. A micro peristaltic pump, which comprises:

a) an actuating part comprising a motor and a first force effector driven by the motor;

b) a cartridge part comprising an elastic membrane attached to a cartridge body comprising at least three chambers having inlets and outlets which are sealingly connected in tandem, wherein said elastic membrane attached to said cartridge body forms an enclosed space further comprising a second force effector which interacts with the first force effector, wherein said first force effector is asymmetrically attached to the motor and is rotated by the motor to interact with the second force effectors configured along a circular track; and c) means for controlling movement of the first force effector to and from said cartridge part in a plane substantially parallel to the plane comprising said cartridge part, whereby said chambers covered by the first force effector are open or closed by the interaction of the first and second force effector, wherein either the first force effector or the second force effector is ferromagnetic, and the other is a ferromagnetic, paramagnetic or other types of magnetic substrate that can generate magnetic force with ferromagnet.

2. The micro peristaltic pump of claim 1, wherein said first force effector is attached to the motor and is moved straightly by the motor to interact with the second force effectors configured along a linear track.

3. The micro peristaltic pump of claim 1, wherein when said first force effector is not in close proximity to said second force effector, said chamber are kept closed or open by said second force effector, and when said first force effector is in close proximity to said second chamber, said chambers are kept open or closed by the interaction of said first and second force effector.

4. The micro peristaltic pump of claim 3, wherein the first force effector has a wavy working surface, due to which the movement of the first force effector into close proximity to the cartridge part results in contact between the first and second force effector and the contact opens the chambers the actuating part covers, and when the first force effector moves away, the contact between the first and second force effector disappears and thus the chambers are closed again.

5. The micro peristaltic pump of claim 1, wherein a third force effector is set in the cartridge and interacts with said second force effector.

6. The micro peristaltic pump of claim 5, wherein when said first force effector is not in close proximity to said chambers, the chambers are kept in a single state, wherein said state is either closed or open by the interaction of said second and third force effector, and when said first force effector is in close proximity to said chambers, the chambers are kept in a single state, wherein said state is either open or closed by the strong interaction between said first and second force effector over said third force effector.

7. The micro peristaltic pump of claim 6, wherein said third force effector is ferromagnetic, paramagnetic or any type of magnetic substrate that can generate magnetic force with the second force effector, which prevents the chambers from being kept closed or open by the second force effector.

8. The micro peristaltic pump of claim 6, wherein both the second and third force effector are electrically charged and thus interact by electrostatic force, which prevents the chambers from being kept in a single state, wherein said state is either closed or open by the second force effector.

9. The micro peristaltic pump of claim 6, wherein said third force effector is a flat spring with one end fixed to the cartridge and the other end prevents the chambers from being kept in a single state, wherein said state is either closed or open by the second force effector.

10. The micro peristaltic pump of claim 1, wherein a spacing cover is fixed to the cartridge between the first and second force effector to define the extent to which the chamber is open.

11. A micro peristaltic pump, which comprises:

a) an actuating part comprising a motor and a first force effector driven by the motor; and b) a cartridge part comprising an elastic membrane attached to a cartridge body comprising at least three chambers having inlets and outlets which are sealingly connected in tandem, wherein said elastic membrane attached to said cartridge body forms an enclosed space further comprising a second force effector which interacts with the first force effector, wherein said first force effector is a sector permanent magnet which is asymmetrically attached by a flange to the rotor of said motor, and all chambers within the cartridge are configured along a circular track of the first force effector, wherein either the first force effector or the second force effector is ferromagnetic, and the other is a ferromagnetic, paramagnetic or other types of magnetic substrate that can generate magnetic force with ferromagnet.

12. The micro peristaltic pump of claim 11, wherein there are three chambers within said cartridge, within which every chamber has its inlet and outlet, and all inlets and outlets are connected in tandem with the inlet of the first chamber and the outlet of the third chamber serving as the inlet and outlet for the fluidic system in the cartridge.

13. The micro peristaltic pump of claim 11, wherein a spacing cover is fixed to the cartridge between the first and second force effectors.

14. The micro peristaltic pump of claim 12, wherein a spacing cover is fixed to the cartridge between the first and second force effectors.

15. The micro peristaltic pump of claim 13, wherein said spacing cover, elastic membrane and cartridge are fixed together by screws.

16. The micro peristaltic pump of claim 14, wherein said spacing cover, elastic membrane and cartridge are fixed together by screws.

17. The micro peristaltic pump of claim 11, wherein a third force effector is set in the cartridge and interacts with said second force effector.

18. The micro peristaltic pump of claim 17, wherein said third force effector is a flat spring with one end fixed to the cartridge and the other end interacts with said second force effector by contact.

19. The micro peristaltic pump of claim 11, wherein the first force effector has a wavy working surface, where the first force effector interacts with the second force effector.

20. The micro peristaltic pump of claim 19, wherein according to the first force effector, a third force effector is set in the cartridge with the second force effector, and has some convex parts in order to interact mechanically with the first force effector by contact.

21. The micro peristaltic pump of claim 20, wherein said third force effector is a flat spring which has a convex part.

22. The micro peristaltic pump of claim 11, wherein said first force effector is manufactured as a part of said motor.

23. The micro peristaltic pump of claim 19, wherein said first force effector is manufactured as a part of said motor.

24. The micro peristaltic pump of claim 11, wherein said elastic membrane is attached to said cartridge by adhesion, welding or ultrasonic welding.

25. The micro peristaltic pump of claim 17, wherein said elastic membrane is made of rubber or poly-siloxane.

26. The micro peristaltic pump of claim 11, wherein the inlet and outlet of said chambers are connected via external tubings.

27. The micro peristaltic pump of claim 17, wherein the inlet and outlet of said chambers are connected via fabricated channels on the cartridge part.

28. The micro peristaltic pump of claim 11, wherein said second force effector is fabricated to the interior of said elastic membrane.

29. The micro peristaltic pump of claim 17, wherein said second force effector is fabricated to the interior of said elastic membrane.

30. The micro peristaltic pump of claim 11, wherein said second force effector is attached to the elastic membrane by adhesion, welding or mechanical means.

31. The micro peristaltic pump of claim 17, wherein said second force effector is attached to the elastic membrane by adhesion, welding or mechanical means.

* * * * *